US008863673B2

(12) United States Patent
Diepenbrock

(10) Patent No.: US 8,863,673 B2
(45) Date of Patent: Oct. 21, 2014

(54) OUTDOOR TABLES WITH HEATER ACCESS

(71) Applicant: Robert Diepenbrock, Chandler, AZ (US)

(72) Inventor: Robert Diepenbrock, Chandler, AZ (US)

( * ) Notice: Subject to any disclaimer, the term of this patent is extended or adjusted under 35 U.S.C. 154(b) by 0 days.

(21) Appl. No.: 13/963,836

(22) Filed: Aug. 9, 2013

(65) Prior Publication Data

US 2014/0041556 A1 Feb. 13, 2014

Related U.S. Application Data

(60) Provisional application No. 61/734,861, filed on Dec. 7, 2012, provisional application No. 61/682,153, filed on Aug. 10, 2012.

(51) Int. Cl.

| | |
|---|---|
| ***A47B 37/00*** | (2006.01) |
| ***A47B 13/08*** | (2006.01) |
| ***A47B 37/04*** | (2006.01) |
| ***A47B 13/00*** | (2006.01) |

(52) U.S. Cl.

CPC ..... *A47B 13/00* (2013.01); *A47B 13/088* (2013.01); *A47B 37/04* (2013.01)

USPC ..... 108/50.13; 108/64; 108/65

(58) Field of Classification Search

CPC ..... A47B 37/00; A47B 31/02; A47B 2200/06

USPC ..... 108/50.12, 50.13, 25, 26, 64, 65, 27, 108/184, 183; 16/254, 270, 261, 262, 263, 16/386; 248/519, 163.2, 176.2, 188, 248/188.1; 211/126.9, 133.2, 133.5, 126.8

See application file for complete search history.

(56) References Cited

U.S. PATENT DOCUMENTS

| | | | | | |
|---|---|---|---|---|---|
| 1,197,483 | A | * | 9/1916 | Hauser | 16/262 |
| 2,094,915 | A | * | 10/1937 | Dawson | 126/25 R |
| 3,025,849 | A | * | 3/1962 | Zimmerman | 126/43 |
| 4,541,256 | A | * | 9/1985 | Green | 70/232 |
| 4,787,319 | A | * | 11/1988 | Dupraz | 108/64 |
| 4,901,959 | A | * | 2/1990 | Stage | 248/97 |
| 5,033,161 | A | * | 7/1991 | Chavez | 16/262 |
| D334,313 | S | * | 3/1993 | Grosfillex | D6/487 |
| 5,341,750 | A | * | 8/1994 | Fuchs | 108/64 |
| 5,485,795 | A | * | 1/1996 | Williams | 108/69 |
| 5,558,246 | A | * | 9/1996 | Ross, Jr. | 220/737 |
| 5,775,315 | A | * | 7/1998 | Baykal | 126/25 R |

(Continued)

*Primary Examiner* — Janet M Wilkens

(74) *Attorney, Agent, or Firm* — Quarles & Brady LLP

(57) ABSTRACT

An outdoor table is divided into two or more sections to allow one or more heaters to be placed and accessed within the perimeter of the table top without removing any support parts of the table. The table top includes at least one aperture through which a heater projects. Each section of the table may be hinged to one or more adjacent sections at one or both ends of the separation between the sections so that the table sections may be swung open and closed. The hinging mechanisms may have a removable pin or bolt that may be removed to open the table from either side of the separation. The table sections may be used as a stand-alone table when detached from each other. One or more inserts may be used to cover the aperture, to change the size of the aperture, or to accommodate additional table features.

17 Claims, 16 Drawing Sheets

(56) References Cited

U.S. PATENT DOCUMENTS

| | | | | |
|---|---|---|---|---|
| 6,192,878 | B1 | 2/2001 | Waters | |
| 6,321,662 | B1 * | 11/2001 | Fraise | 108/25 |
| 6,347,591 | B1 * | 2/2002 | Karpa et al. | 108/50.11 |
| D456,498 | S | 4/2002 | Jeng | |
| D462,427 | S | 9/2002 | Jeng | |
| D462,854 | S * | 9/2002 | Corning et al. | D6/480 |
| 7,296,522 | B1 * | 11/2007 | Mahmalji | 108/50.13 |
| 8,245,649 | B1 * | 8/2012 | Ratliff et al. | 108/25 |
| 2004/0026487 | A1 * | 2/2004 | Brook | 229/75 |
| 2007/0012223 | A1 * | 1/2007 | Flusche | 108/26 |
| 2007/0056482 | A1 * | 3/2007 | Robinson et al. | 108/25 |
| 2007/0062418 | A1 * | 3/2007 | Li | 108/50.12 |
| 2010/0175593 | A1 * | 7/2010 | Davis | 108/25 |

* cited by examiner

OUTDOOR TABLES WITH HEATER ACCESS

FIELD OF INVENTION

This invention relates to furniture. This invention relates particularly to outdoor tables configured to receive one or more outdoor heaters.

BACKGROUND

Tower-style patio heaters, referred to herein as "tower heaters" and illustrated in FIG. 1, are frequently used in outdoor common areas to provide warmth to people in the vicinity of the heater. Tower heaters radiate heat, typically generated by combustion of liquid propane gas (LPG) or natural gas, or by an electrical heating element, to warm a circular area around and under the heater. Unfortunately, for outdoor seating, such as on a residential patio or in a patio section of a restaurant, the heater is typically located beside the table and therefore does not evenly warm the people around the table. It would be advantageous to locate the heater at the center of the table to evenly distribute the heater's effective radius. However, placing a tall, heavy, high-temperature heater on a table top is impractical and unsafe, and is therefore not a viable option.

Heater tables exist that have a heater built into the table, or alternatively have a table built around the heater. U.S. Pat. No. 6,192,878 and U.S. Des. Pat. No. D462,427 illustrate two examples of a small table top built around a tower heater. However, these tables are sized to accommodate three people at most. Scaling such a design up so that the table top has enough surface area to accommodate four or more people comfortably presents two major problems. First, a table with a permanently attached heater becomes unwieldy and is too heavy or too large to move easily. Second, it becomes difficult to access the propane tank and associated controls contained in the base of the tower heater due to the increased area of the table top. A heater table that seats four or more people, accommodates a heater within its perimeter, is easy to move, and allows easy access to the propane tank, is needed.

One known table, described in U.S. Pat. No. 7,296,522, attempts to overcome the drawbacks of previous heater tables by providing a table top that has an aperture in the center through which a tower heater projects. The table splits completely in half to provide access to the heater's tank housing. The two halves of the table can be moved separately from the heater. This heater table presents several of its own drawbacks. First, a support brace that attaches to the table legs must be removed in order to separate the table top halves. This creates additional steps for gaining access to the tank or moving the table. Second, and relatedly, with the support brace removed, each half of the table lacks support and thus cannot be used as a table when separated from the other half. Third, because the halves are not supported when separate, opening and closing the table is a two-person undertaking, with one person holding each half. Finally, as the table increases in size, such as to a six- or eight-person dining table, some people will be seated outside the radius of the single, centrally-located heater. A heater table that overcomes these drawbacks is needed.

Therefore, it is an object of this invention to provide a heater table that accommodates a tower heater within its perimeter, is easy to move, and provides easy access to the heater's tank housing. It is a further object that the housing be accessible without removing any support structures. It is a further object that the heater table be easily moved between an open and a closed position by a single person. It is another object that the heater table be divided into sections that are separately configured to serve as stand-alone tables. It is a further object that the table sections have different shapes that may be mixed and matched to allow different table configurations. It is another object that the table is configured to receive features in addition to tower heaters, such as umbrellas and fire plates. It is yet another object of the invention to provide a dining-sized heater table that adequately heats all seating positions.

SUMMARY OF THE INVENTION

An outdoor table having a table top and support structure is divided into two or more sections to allow one or more heaters to be placed and accessed within the perimeter of the table top without removing any support parts of the table top or support structure. Preferably, the table is configured to facilitate the placement of the heaters centrally in order to provide heat to people located around the perimeter of the table top. Each section of the table is hinged to one or more adjacent sections at one or both ends of the separation between the sections so that the table sections may be swung open by a single person to provide access to the heaters, and then swung closed to form the table top for use. Preferably, the sections are hinged at both ends of the separation by a hinging mechanism having a removable pin or bolt that may be removed to open the table from either side of the separation. The sections may have mating alignment structures positioned on the edges of the table top facing the separation to align the sections when closing the table. The table sections may include parts of the support structure that provide adequate support to each section so that each section may be used as a stand-alone table when the table is open.

When the table is closed, the mated sections form one or more apertures in the table top through which a heater projects. One or more inserts may be used to cover the aperture, to change the size of the aperture, or to accommodate additional table features such as a table umbrella. The insert may also comprise a solid table top insert or a decorative or functional feature, such as a fire plate or fire bowl. In the preferred embodiment, the table height and aperture size are selected to accommodate a standard-size propane "tower" patio heater.

DETAILED DESCRIPTION OF THE INVENTION

Figure 1:
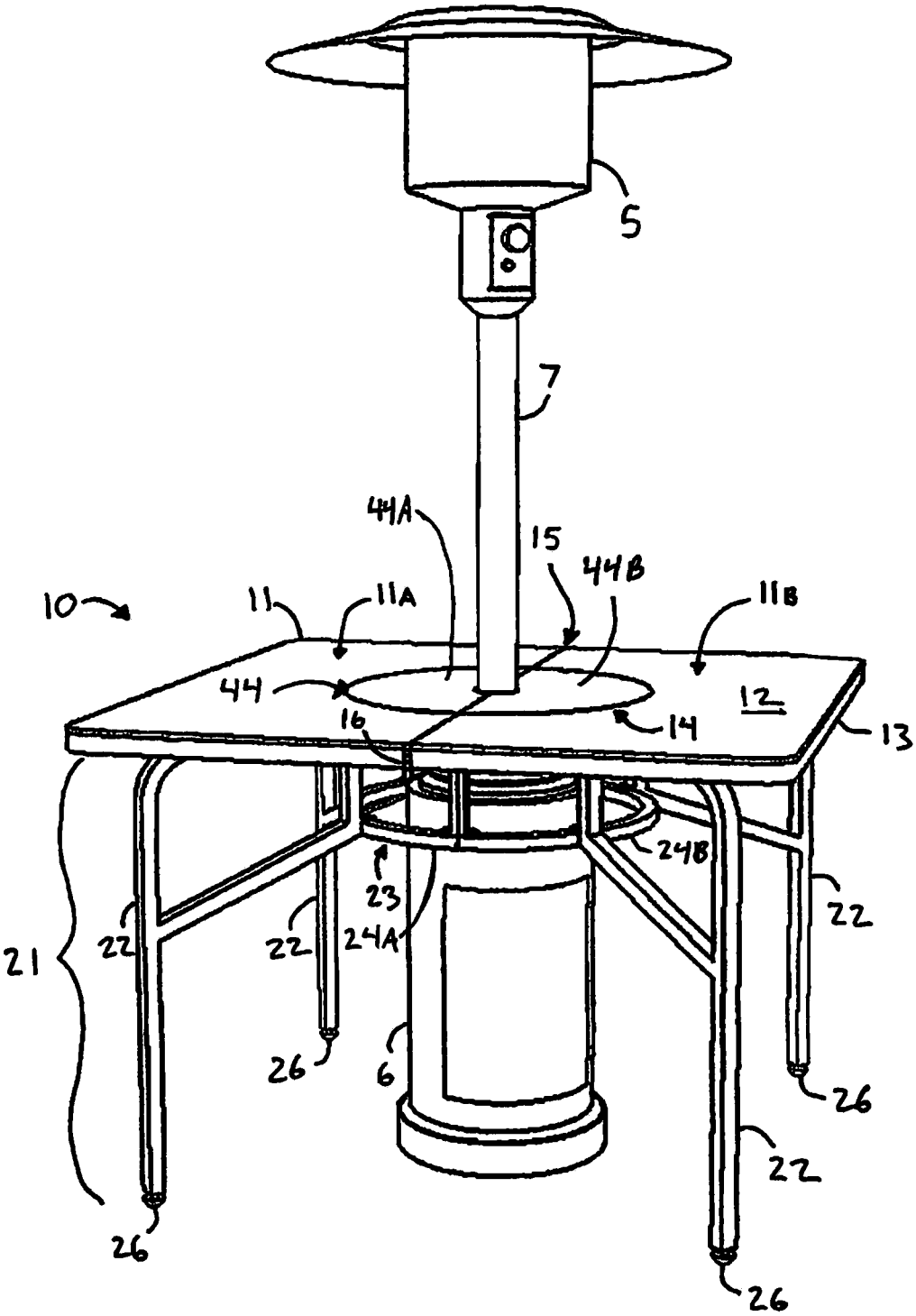
FIG. 1 is a top perspective view of a first embodiment of the present invention in the closed position.
Figure 2:
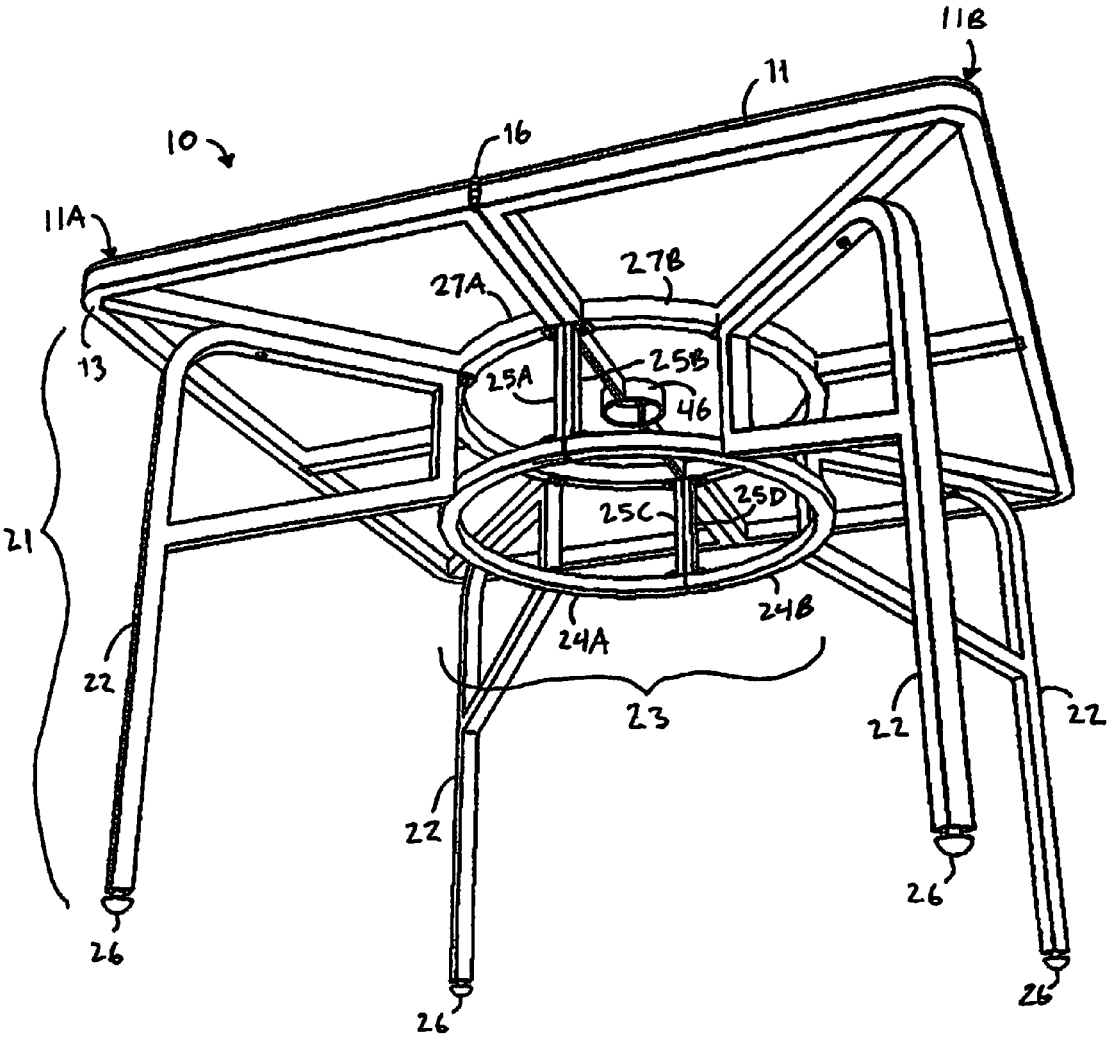
FIG. 2 is a bottom perspective view of the first embodiment in the closed position.
Figure 3:
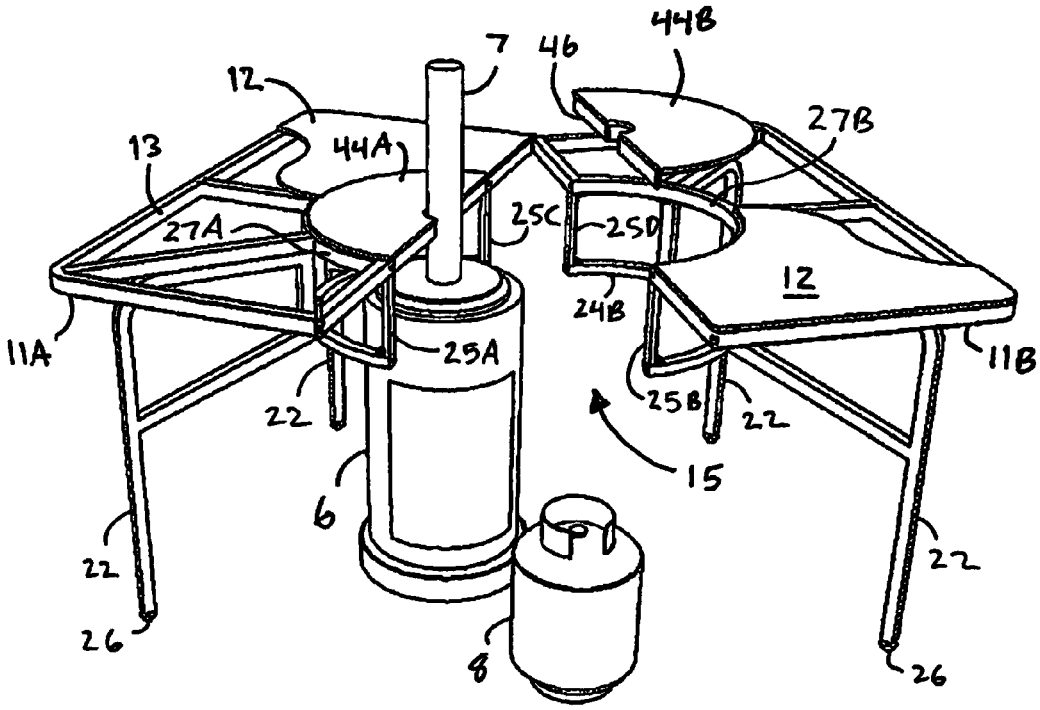
FIG. 3 is a top perspective view of the first embodiment in an open position with the table top shown in cutaway.
Figure 4:
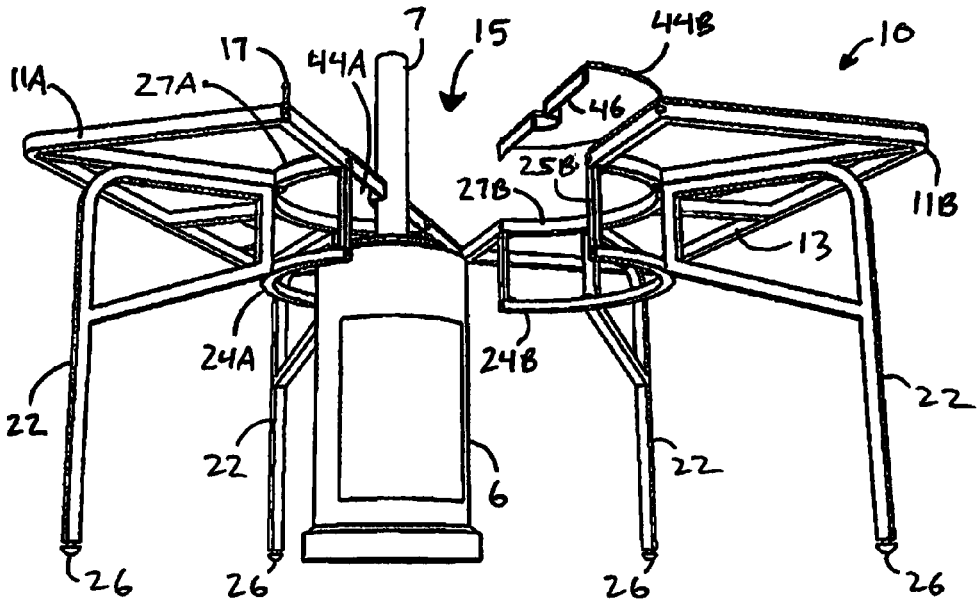
FIG. 4 is a bottom perspective view of the first embodiment in an open position.

Referring to FIGS. 1-4, there is illustrated the first embodiment of the present invention designated generally as 10 which is a table for outdoor use that accommodates a tower heater 5 to be placed inside the perimeter of the table in order to evenly provide warmth to the people located around the table. Preferably, and as illustrated, the table accommodates a standard-sized tower heater 5 that includes a substantially cylindrical housing 6 for a standard 20 lb propane tank 8, and a post 7 extending vertically from the housing. The first embodiment is a square table having a table top 11 configured to seat four people comfortably. The table top 11 may be any suitable material, including but not limited to: a single solid block of material, such as granite, wood, or plastic; a combination table surface and frame, the surface being plastic, glass, metal, or another material, and the frame being plastic or metal; or, a plastic or metal frame with surface elements inset therein, and positioned flush with the top of the frame to form the table surface. Preferably, the table top 11 comprises a table surface 12 attached to a frame 13. An aperture 14 is disposed through the table top 11. The aperture 14 is sized and positioned to receive the tower heater 5. The table top 11 is divided into two sections 11A, 11B at a separation 15 that extends from one side of the table top 11 to the opposite side. The separation 15 passes through the aperture 14. Preferably, the separation 15 divides the table top 11 in half, forming symmetric sections 11A, 11B.

The table top 11 is attached to a support structure 21 comprising a plurality of legs 22 attached to a brace 23. In the first embodiment, four legs 22 are attached to the underside of the frame 13 and positioned substantially near the corners of the table top 11. A foot 26 may be attached to the bottom of each leg 22 to provide a contact surface with the ground. Preferably, the feet 26 are adjustable to level and balance the table 10 as is known in the art. Alternatively or in addition to the feet 26, a lockable wheel assembly, such as the lockable caster 61 of FIG. 15, may be attached to the bottom of some or all of the legs 22 to facilitate moving the table 10.

Figure 14:
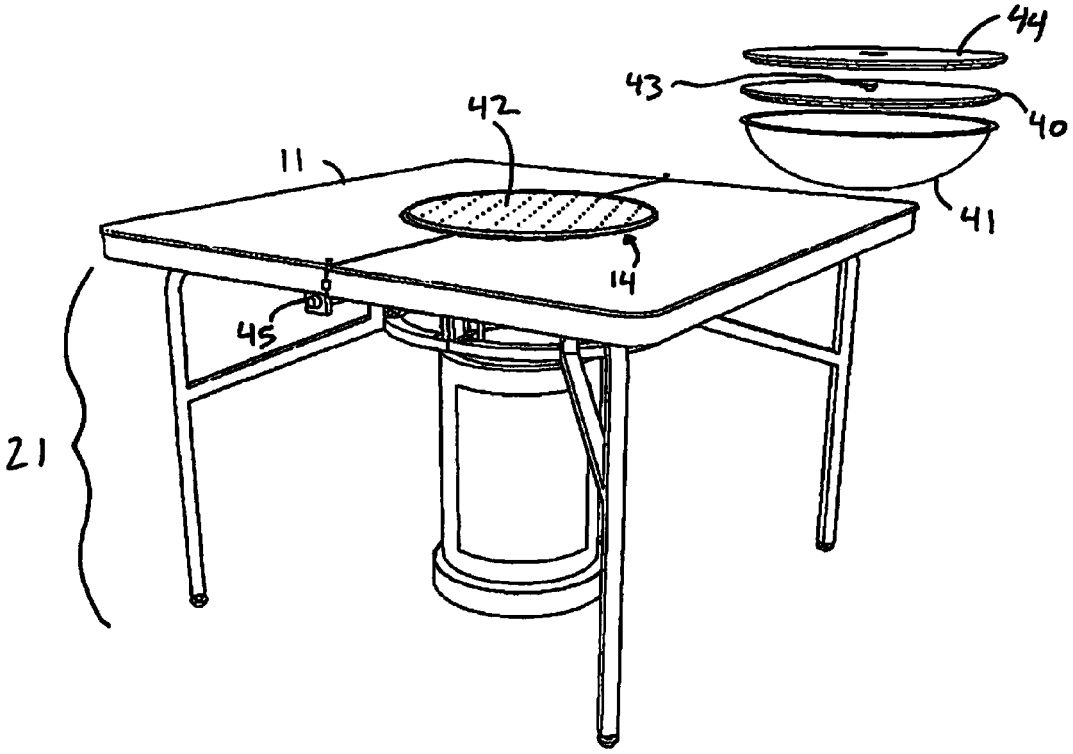
FIG. 14 is a top perspective view of the first embodiment of the table equipped with a fire feature.

The brace 23 is vertically positioned between the table top 11 and the ground and comprises lower horizontal members 24A, 24B, upper horizontal members 27A, 27B, and vertical members 25A-D symmetrically divided by attachment to the sections 11A, 11B of the table top 11. The lower horizontal members 24A, 24B each attach to two of the legs 22 and meet each other at the separation 15 to encircle the housing 6. Preferably, each of the lower horizontal members 24A, 24B is a semicircular bar, so that together the lower horizontal members 24A, 24B form a circular brace 23 that is highly supportive and also conforms closely to the housing 6 to prevent the housing 6 from tipping or shifting significantly. The upper horizontal members 27A, 27B are the same shape and size as the lower horizontal members 24A, 24B, and are preferably semi-circular. The upper horizontal members 27A, 27B may be attached to or integral with the frame 13 of each section of the table top 11. The upper horizontal members 27A, 27B may also encircle the housing 6 depending on the height of the legs 22. More importantly, the upper horizontal members 27A, 27B provide support for a sizing insert 44 or another insert, such as or a fire bowl 41 or fire plate 42 as illustrated in FIG. 14 and described below. The insert abuts the upper horizontal members 27A, 27B when in place inside the aperture 14. To increase the supportive effect of the brace 23, the vertical members 25A-D each attach to an end of one of the horizontal members 24A, 24B, extending up and attaching to the respective section 11A, 11B frames 13. The vertical members 25A, 25C of one section 11A abut the vertical members 25B, 25D of the other section 11B across the separation 15 when the table 10 is closed, improving the support provided by the brace 23.

In some embodiments, the aperture 14 is approximately the same diameter as the circle formed by the abutting upper horizontal members 27A, 27B of the brace 23. A sizing insert 44 may be provided to fit inside the aperture 14 and change the size of the opening that passes through the table 10. For example, the sizing insert 44 may have an opening at its center to accommodate the tower heater support post 7 or an umbrella support post of a similar or smaller diameter. Preferably, the sizing insert 44 is halved into a first section 44A that fits into one section 11A of the table 10, and a second section 44B that fits into the other section 11B. The sections 44A, 44B of the sizing insert 44 abut each other and encircle the tower heater support post 7 when the table 10 is closed. A downward-extending lip 46 may be attached to the end of each sizing insert section 44A, 44B on the side that faces the separation 15. The lip 46 may be configured to maintain a contiguous appearance of the frame 13 when the table 10 is open, particularly by being the same height and made of the same material as the frame 13. The sizing insert 44 may also be solid with an opening at its center to accommodate an umbrella support post of a similar or smaller diameter.

Figure 5:
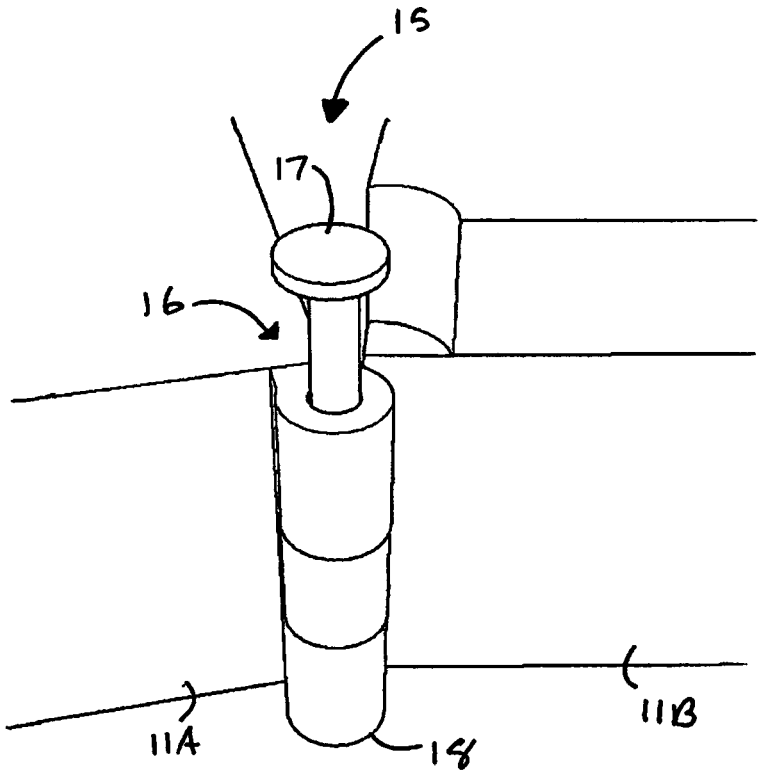
FIG. 5 is a close-up perspective view of the preferred hinging mechanism of the present invention.

The sections 11A, 11B of the table top 11 are attached to each other with at least one hinging mechanism 16. The hinging mechanism 16 may be any suitable mechanical hinge configured to attach to both sections 11A, 11B across the separation 15 and rotate about an axis that allows the table 10 to translate between the closed position of FIGS. 1-2 and an open position, such as that of FIGS. 3 and 4. In addition to functioning as a hinge, the hinging mechanism 16 may further be configured to detach from one of the sections 11A, 11B or to come apart across the separation 15. Referring to FIG. 5, the preferred hinging mechanism 16 is a modified barrel hinge having a fastening pin 17 that can be inserted and removed from the top of the barrel 18. With the fastening pin 17 removed, the barrel 18 may be pulled apart. In this fashion, the table top 11 may be hinged across both ends of the separation 15, allowing the table 10 to be opened from either side as needed. Alternatively, one conventional hinging mechanism 16 may be used, and the table top 11 may be secured closed at the end of the separation 15 opposite the hinging mechanism 16 by a standard latch (not shown).

Figure 6A:
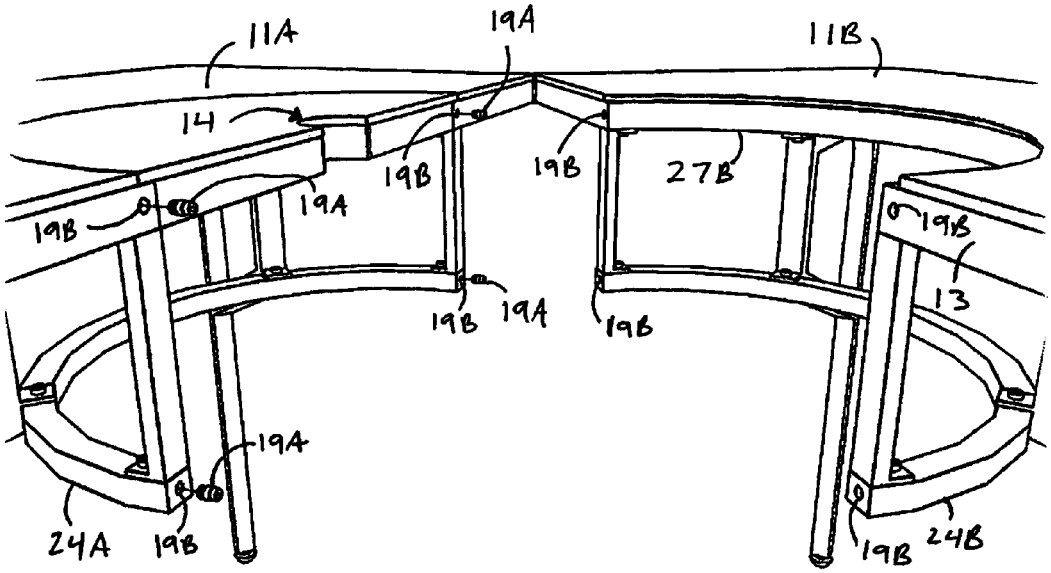
FIG. 6A is a close-up perspective view of the table separation in the first embodiment.
Figure 6B:
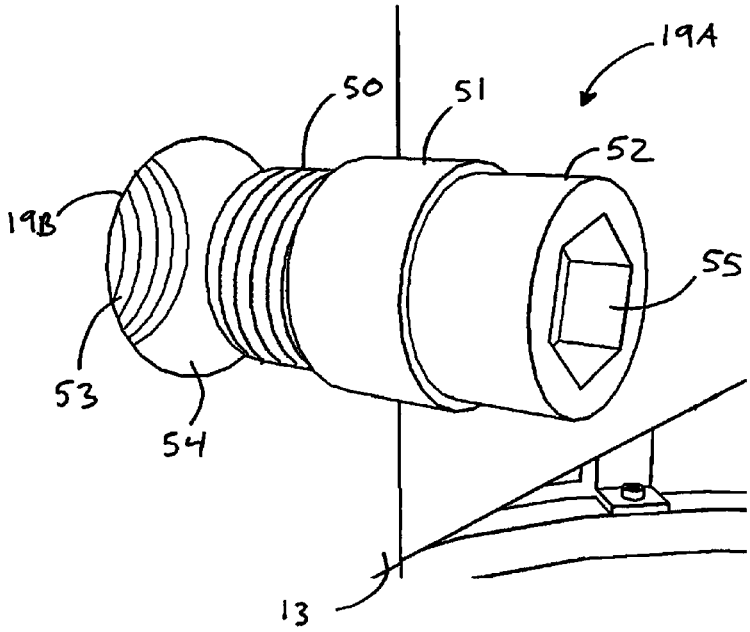
FIG. 6B is a close-up perspective view of the alignment pins shown in FIG. 6A.

Referring to FIG. 6A, to facilitate opening and closing of the table top 11, the sections 11A, 11B may comprise one or more mating alignment structures projecting into or recessed from the separation 15. Insertable alignment pegs 19A may be inserted into the frame 13 to extend a short distance normally from the frame 13 of one section 11A, with the other section 11B having cooperating recesses 19B inset normally from its frame 13. The alignment pegs 19A and recesses 19B mate to ensure that the perimeters of the table top 11 and the aperture 14 are correctly aligned when closing the table 10. Most preferably, both sections 11A, 11B comprise alignment recesses 19B, and the pegs 19A are inserted into the recesses 19B of one of the sections 11A, 11B. FIG. 6B illustrates the preferred alignment pegs 19A and recesses 19B in detail. The pegs 19A and recesses 19B may be matedly threaded to allow the pegs 19A to be screwed into the recesses 19B. The peg 19A comprises a threaded section 50, a smooth section 51, and a projecting section 52, while the recess 19B comprises a threaded section 53 inset from the outer surface of the frame 13 by a smooth section 54. The threaded sections 50, 53 of the peg 19A and recess 19B mate to retain the peg 19A. The peg 19A may be screwed into place by hand, or a hex fitting 55 or other screwdriver fitting may be provided on the end of the pin 19A for screwing the pin 19A into place. When the peg 19A is in place, the smooth section 51 of the peg 19A extends to the outer surface of the frame 13, and the projecting section 52 extends out from the frame 13 for insertion into the cooperating recess across the table separation 15. The projecting section 52 may be as long as the smooth section 53 of the opposing recess 19B is deep.

Figure 7:
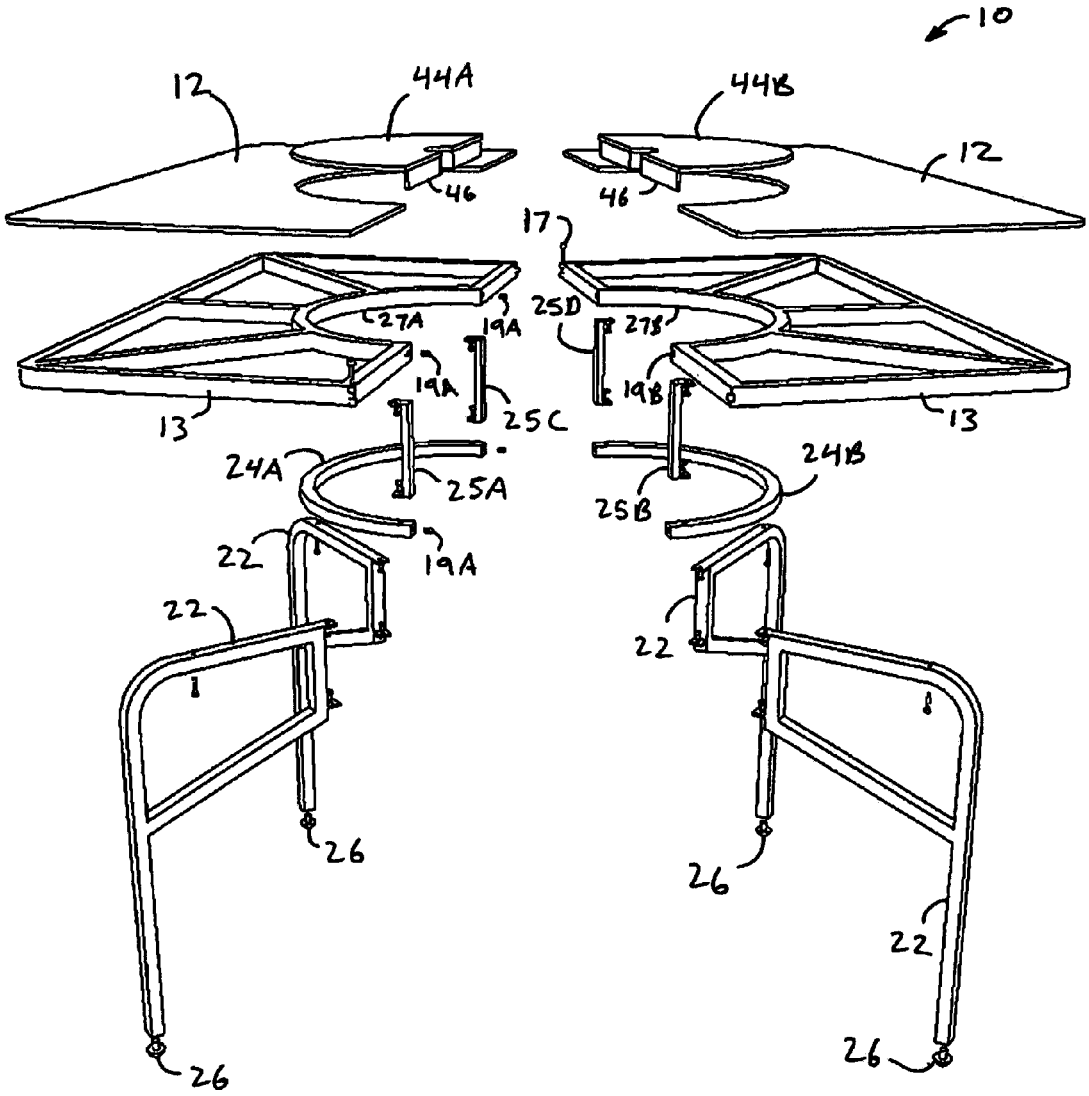
FIG. 7 is an exploded front perspective view of the first embodiment.

FIG. 7 illustrates the components of the first embodiment of the table 10 in exploded view. Preferably the parts of the table 10 are symmetrical across the separation 15 and therefore highly repeatable in order to reduce manufacturing costs and ensure reliable production and assembly of the table 10. In particular, the following parts may be identical, minimizing the number of part designs for manufacturing and simplifying assembly and repair: the feet 26; the legs 22; the horizontal members 24A, 24B; the vertical members 25A-D; the frame 13 of each section 11A, 11B; and the table surface 12 of each section 11A, 11B. The parts may be made of any material suitable for use in outdoor furniture.

Figure 8:
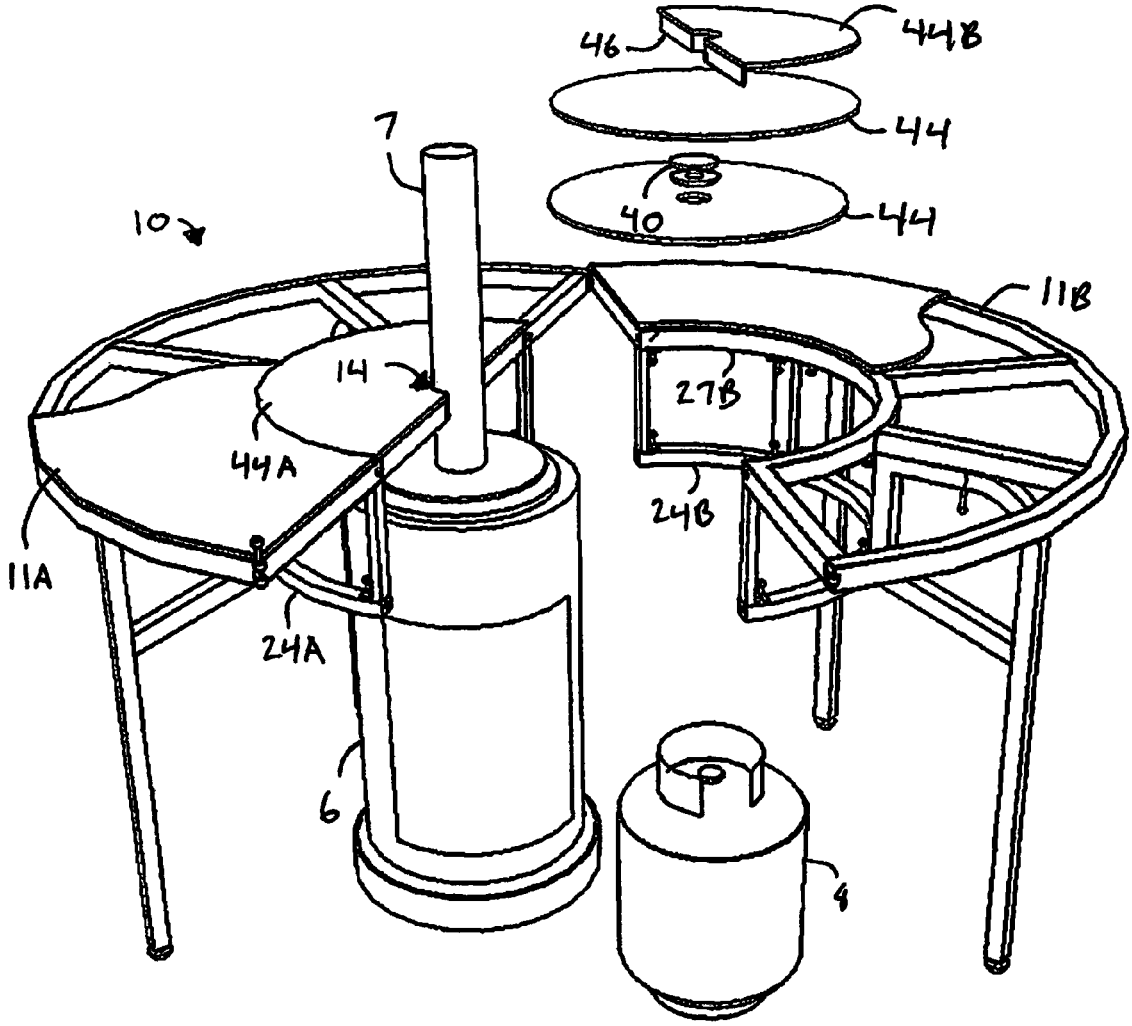
FIG. 8 is a top perspective view of a second embodiment of the present invention in an open position with the table surface shown in cutaway.
Figure 9:
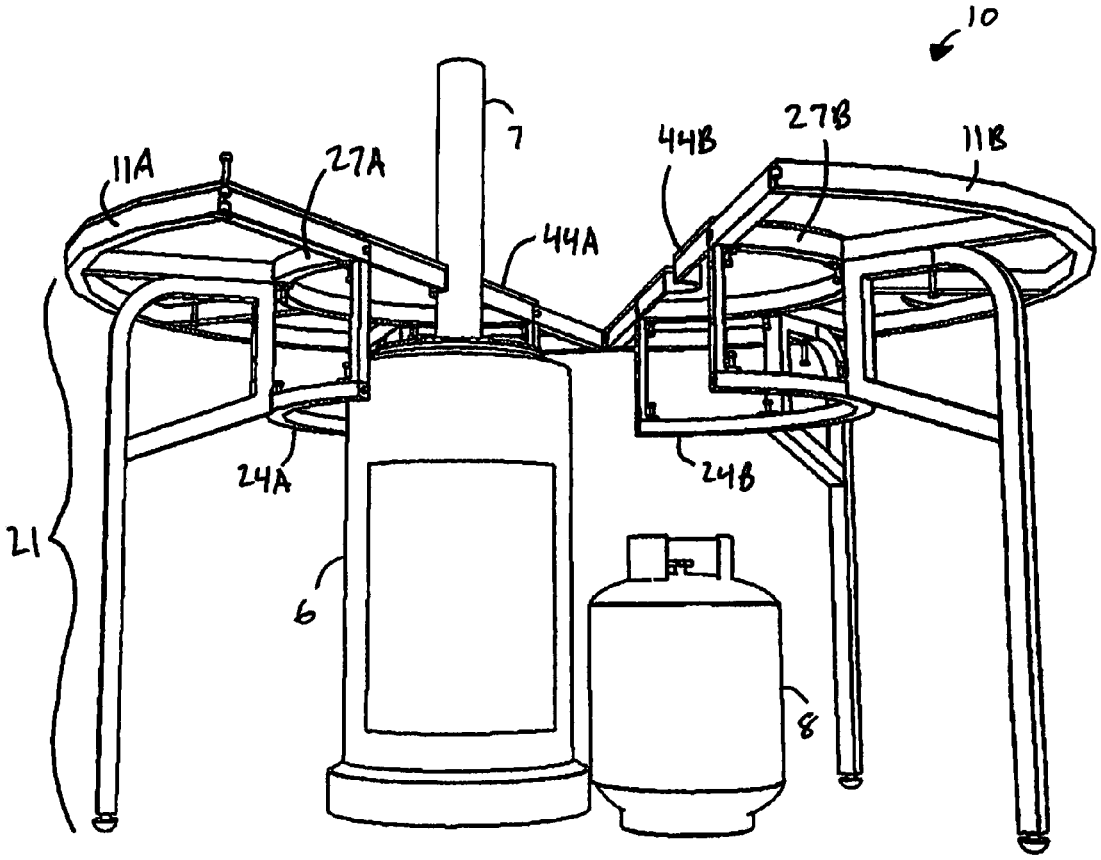
FIG. 9 is a bottom perspective view of the second embodiment in an open position.
Figure 10:
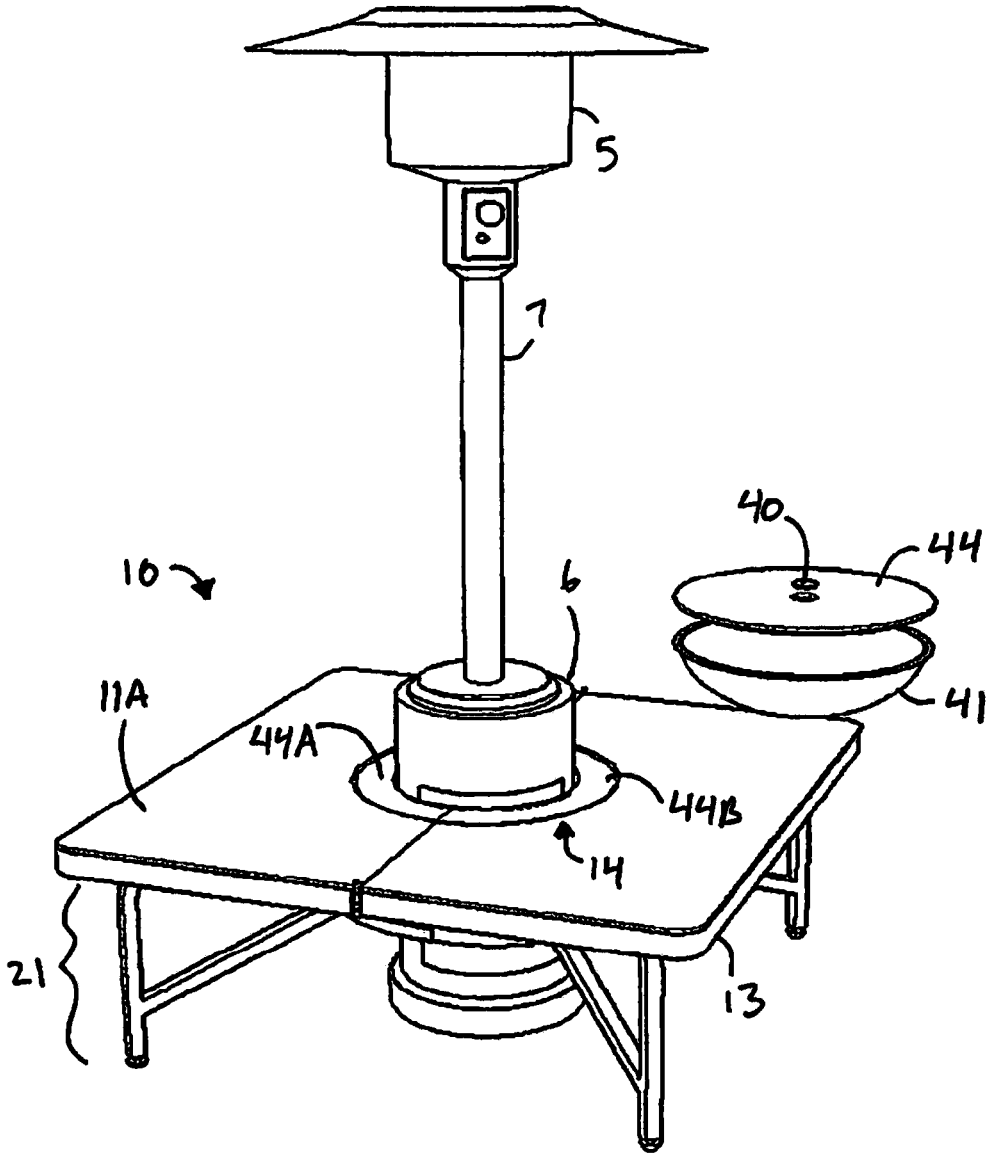
FIG. 10 is a top perspective view of a third embodiment of the present invention in the closed position.

FIGS. 8 and 9 illustrate a second embodiment of the table 10, which has the same design and functionality as the first embodiment except that the table top 11 is substantially circular. This design allows for more people to sit around the table 10 while still receiving evenly-distributed warmth at all seating positions. FIG. 10 illustrates a third embodiment of the table 10, which is lower than the first and second embodiments. Due to the lower table top 11, the aperture 14 of the third embodiment is sized to encircle the tank housing 6 rather than the post 7 of the heater 5. FIG. 10 further illustrates several potential inserts as described below.

Figure 11:
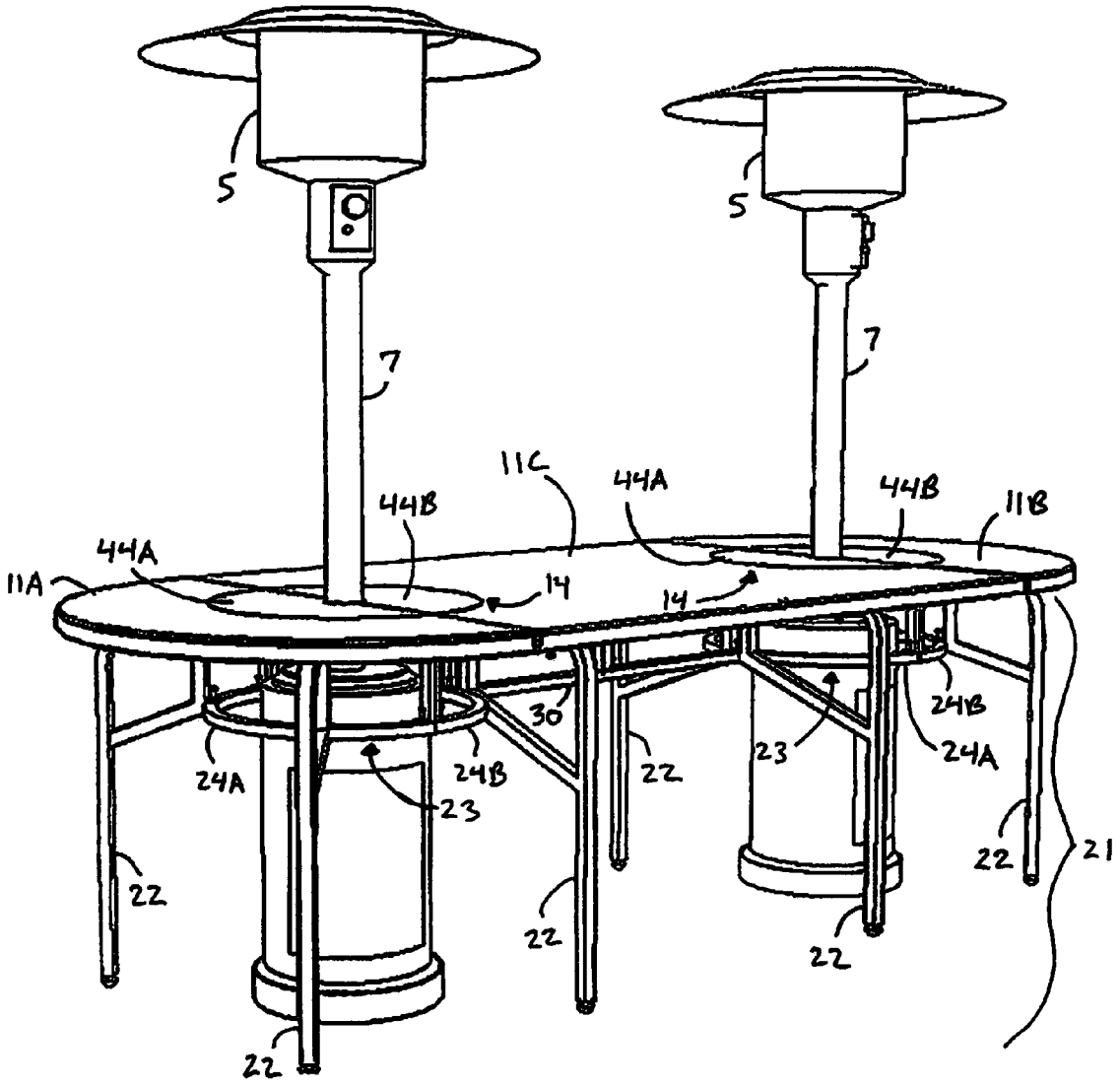
FIG. 11 is a top left perspective view of a fourth embodiment of the present invention in the closed position.
Figure 12:
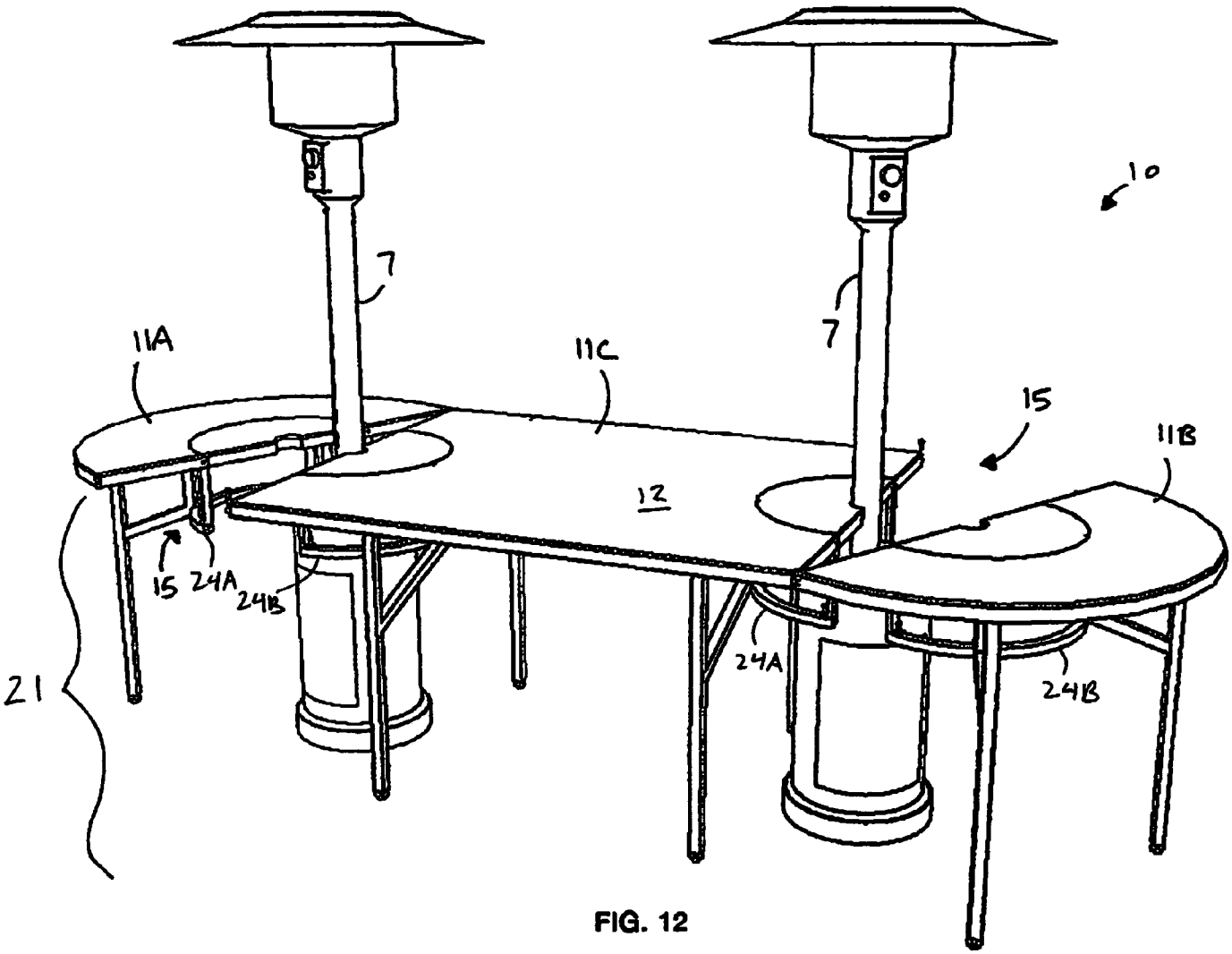
FIG. 12 is a top perspective view of the fourth embodiment in an open position.
Figure 13:
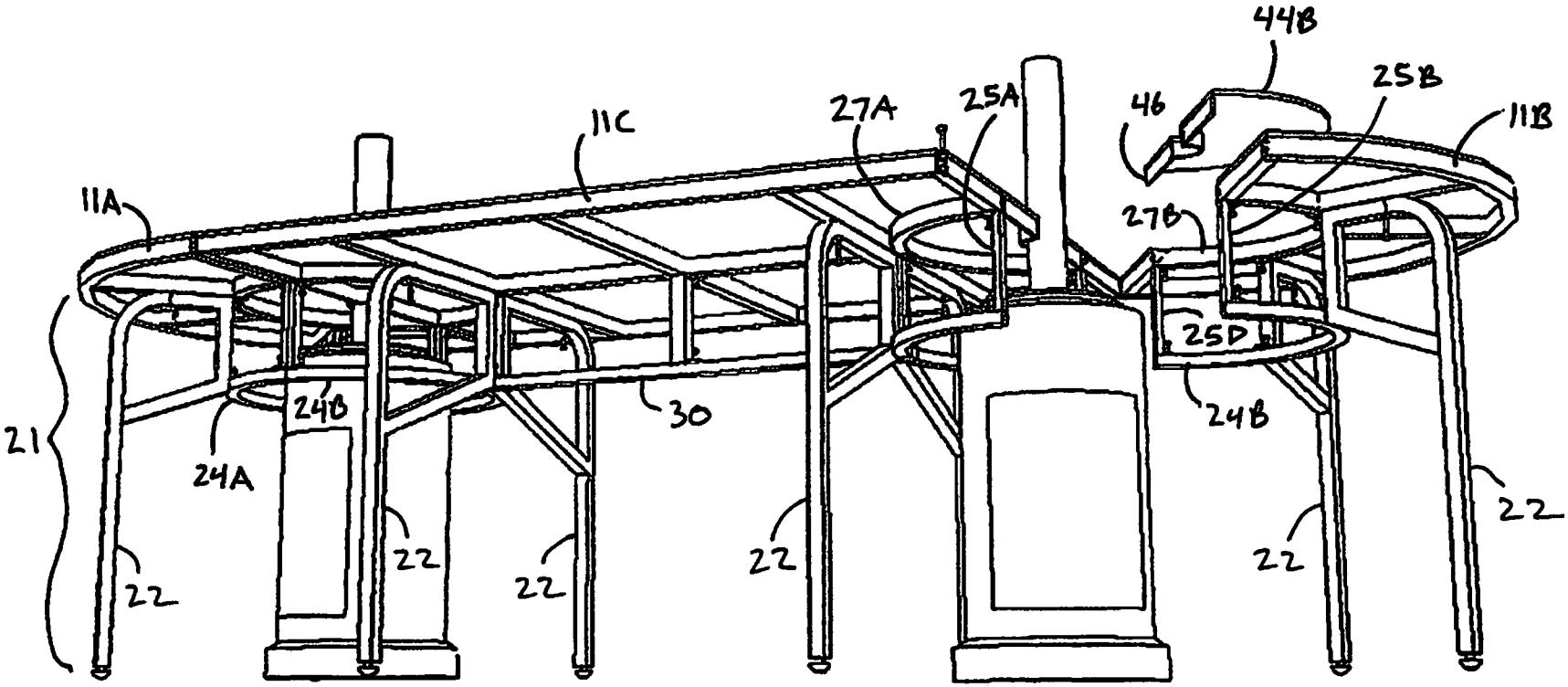
FIG. 13 is a bottom perspective view of the fourth embodiment in an open position.

FIGS. 11-13 illustrate a dining-sized table 10 which accommodates 6-8 people seated. Due to the size of the table 10, a single heater 5 is not sufficient to evenly warm all of the seating positions. Therefore, the design is modified to incorporate two tower heaters 5. Preferably, the tower heaters 5 are positioned at ¼ and ¾ of the length of the table, and centered with respect to the table width. The table top 11 is divided into three sections. The end sections 11A, 11B and their respective support structures 21 are configured as described for the other embodiments above, with the shapes being semicircular as illustrated, square, rounded-square, or a combination thereof. The end sections 11A, 11B are permanently or removably attached as described above to the center section 11C, which is substantially rectangular and has a portion of each aperture 14 formed into its proximal and distal ends. The support structure 21 for the center section 11C comprises a plurality of legs 22, preferably four legs aligned in parallel pairs across the width of the table 10. See FIG. 13. This configuration allows the center section 11C to be used as a stand-alone table if one or both of the end sections 11A, 11B are detached. The pairs of legs 22 may be joined by one or more center support bars 30 running along the length of the table to provide support and keep the legs 22 aligned. One of the horizontal members 24A, 24B of each brace 23 is attached to one or both of the legs 22 in each pair.

Referring to FIGS. 3, 4, 10, and 14, the aperture 14 may be configured to receive other inserts to change its functionality. An insert may be a cover 40 for completely covering the aperture 14. An insert may be a fire feature, such as a metal or ceramic fire bowl 41 with a cover 40 having a handle 43, as is known in the art. An insert may be a fire plate 42 that is perforated to allow gas to escape, as is known in the art. In this embodiment, the table 10 may be equipped with a system 45 for igniting and controlling the fire feature.

Figure 15:
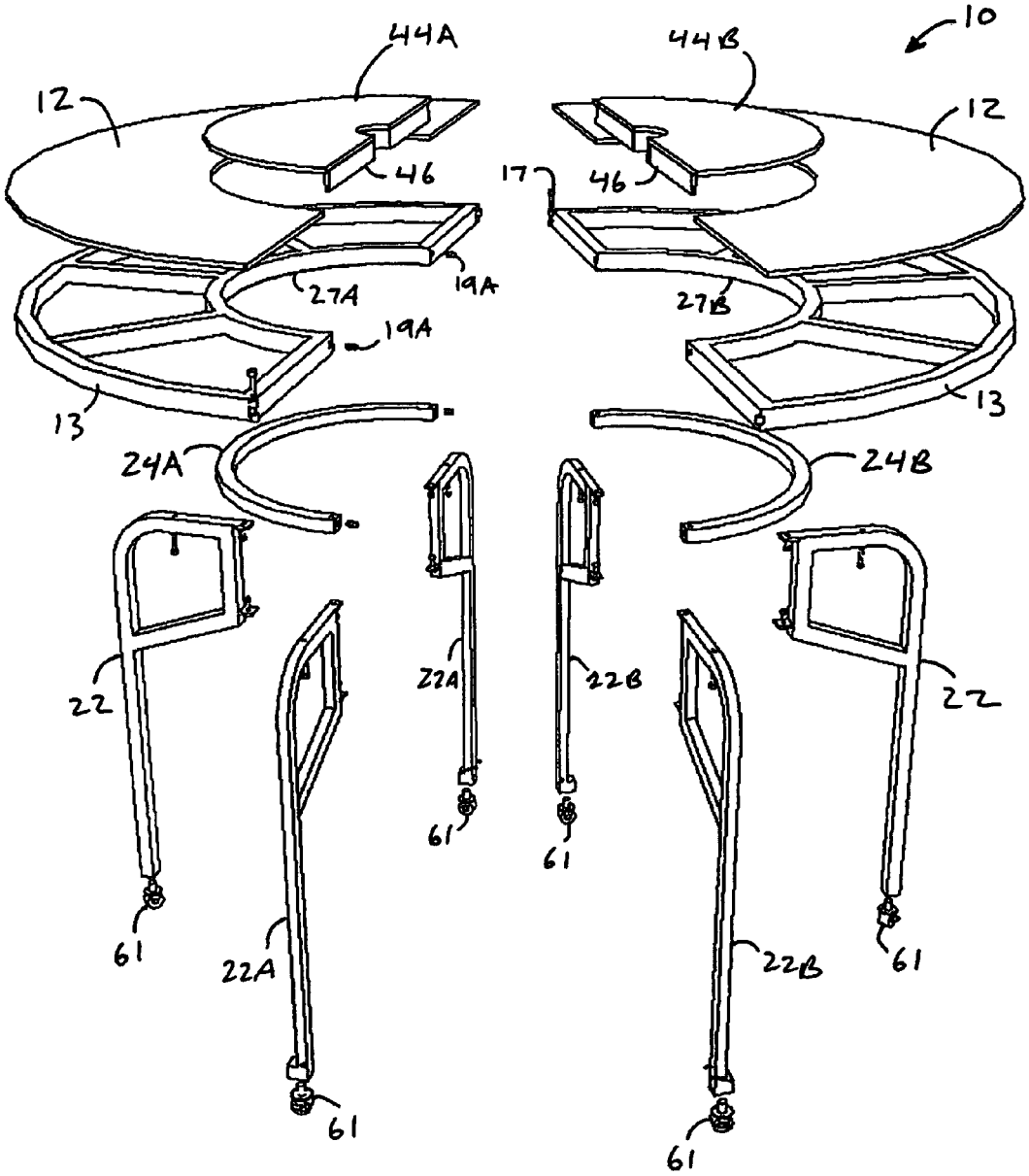
FIG. 15 is an exploded front perspective view of a fifth embodiment of the present invention.
Figure 16:
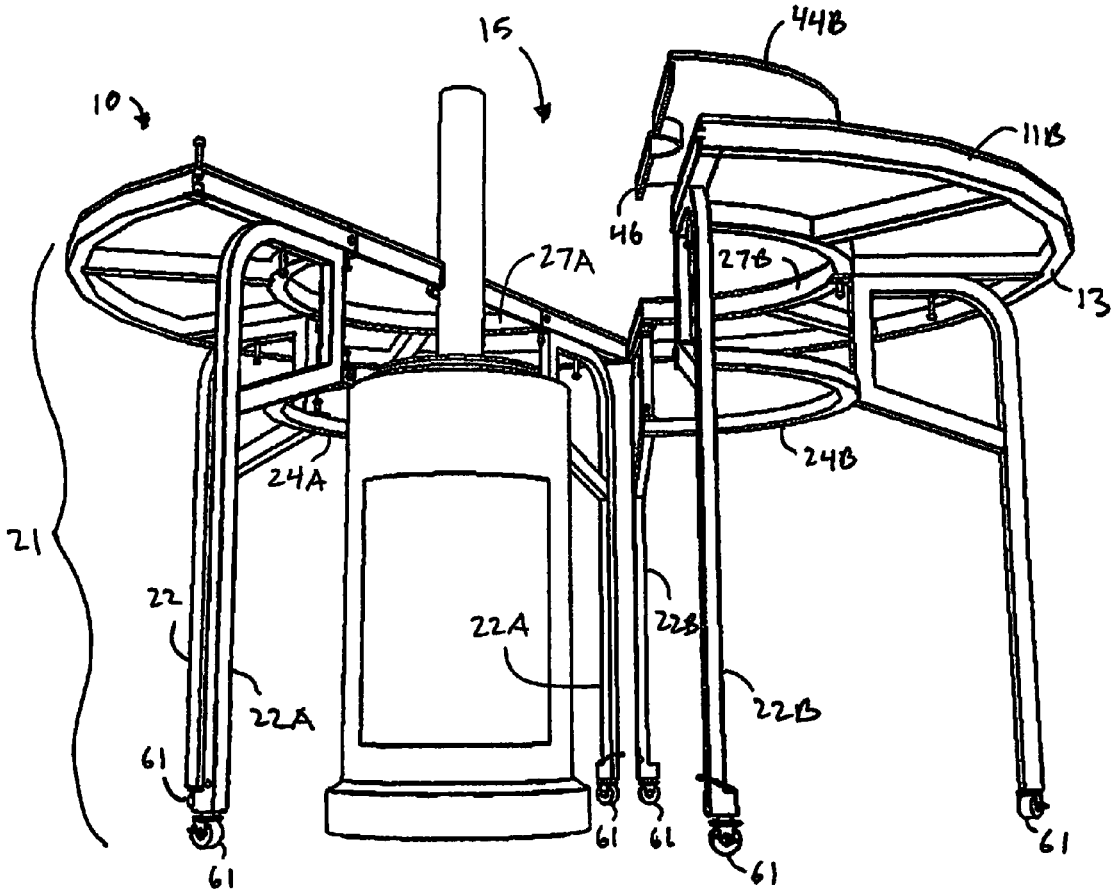
FIG. 16 is a bottom perspective view of the fifth embodiment in an open position.
Figure 17:
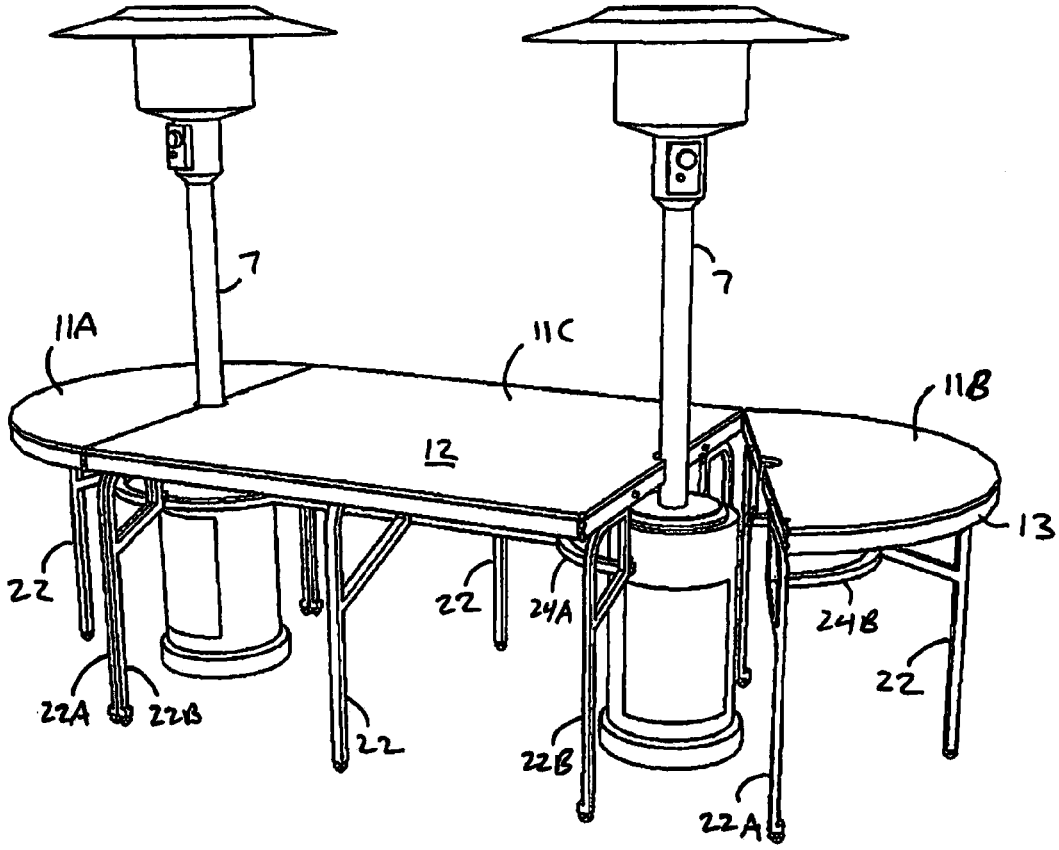
FIG. 17 is a top perspective view of a sixth embodiment of the present invention.
Figure 18A:
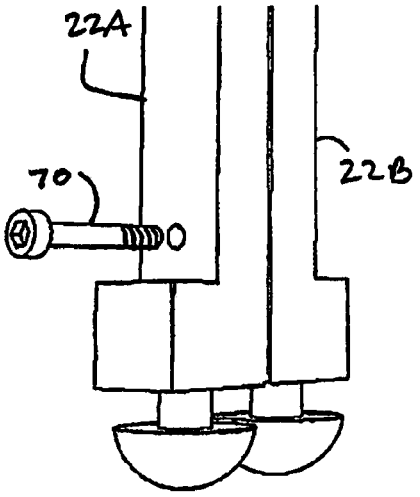
FIGS. 18A and B are close-up perspective views of attachment mechanisms used for the legs of the tables of FIGS. 15-17.
Figure 18B:
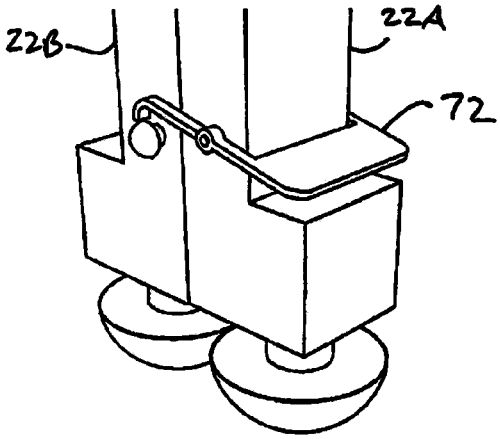

In an alternative embodiment, illustrated in FIGS. 15-17, the table 10 may comprise legs 22 that span the separation 15. Preferably, the legs 22 are bisected into half-legs 22A, 22B that are attached to the respective sections of the table 10 such that opposing half-legs 22A, 22B abut each other across the separation 15 when the table 10 is closed. The sections 11A, 11B of the circular table 10, which correspond to the end sections 11A, 11B of the dining table 10, thus each have two half-legs 22A, 22B and one full leg 22 attached thereto. This configuration gives each section 11A, 11B, 11C the stability to function as a stand-alone table when detached completely from the other sections. Each half-leg 22A, 22B further serves the support function of the vertical members 25A-D in the first embodiment, joining the lower horizontal members 24A, 24B to the upper horizontal members 27A, 27B. In the closed position, the half-legs 22A, 22B may be joined together across the separation 15 to form a full leg 22 and improve the stability of the table 10. An attachment mechanism, such as the threaded bolt 70 shown in FIG. 18A or the spring-loaded catch 71 shown in FIG. 18B, may be used to secure the half-legs 22A, 22B.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

What is claimed is:

1. A table having a perimeter around which a plurality of people may sit, the table comprising:

a table top divided into a first section and a second section by a first separation, the table top comprising a first aperture formed within the perimeter of the table across the first separation; and a support structure comprising a plurality of legs and a brace attached to one or more of the legs and comprising a plurality of members, the support structure being attached to the table top to support the table in:

a first open position, wherein a first tower heater may be placed and accessed within the perimeter of the table without removing any members of the brace; and a first closed position, wherein the first and second sections of the table top abut each other across the first separation and the first tower heater projects through the first aperture;

the support structure being attached to the table top to support the first section of the table top and the second section of the table top as standalone tables when the first section of the table top is detached completely from the second section of the table top along the first separation; and at least two of the plurality of legs being both:

attached to the brace across the first separation; and bisected into two half-legs that abut each other across the first separation when the table is in the first closed position.

2. The table of claim 1, further comprising a first hinging mechanism that attaches the first section of the table top to the second section of the table top at a first end of the first separation, such that the table is opened to the first open position from a second end of the first separation opposite the first end.

3. The table of claim 2, wherein the first hinging mechanism is configured to detach the first section of the table top from the second section of the table top at the first end of the first separation.

4. The table of claim 3, wherein the first hinging mechanism comprises a barrel and a removable fastening pin that inserts into the barrel to attach the first section of the table top to the second section of the table top at the first end of the first separation, and is removable from the barrel to detach the first section of the table top from the second section of the table top at the first end of the first separation.

5. The table of claim 3, further comprising a second hinging mechanism that attaches the first section of the table top to the second section of the table top at the second end of the first separation and is configured to detach the first section of the table top from the second section of the table top at the second end of the first separation, such that the table is configured to be swung open to the first open position from either the first end or the second end of the first separation according to the attachment and detachment of the first and second sections by the first and second hinging mechanisms.

6. The table of claim 5, wherein the support structure supports the first section of the table top and the second section of the table top as standalone tables when the first section of the table top is detached from the second section of the table top by both of the first and second hinging mechanisms.

7. The table of claim 2, further comprising a latch configured to detachably attach the first section of the table top to the second section of the table top at the second end of the first separation.

8. The table of claim 1, wherein the first aperture is larger than a post of the first tower heater.

9. The table of claim 8, further comprising a removable sizing insert configured fit inside the first aperture, the sizing insert having an opening at its center to accommodate the post of the first tower heater.

10. The table of claim 9, further comprising a removable insert comprising a fire feature.

11. The table of claim 9, wherein the first aperture is sized to encircle a tank housing of the first tower heater.

12. The table of claim 1, wherein the table top is further divided into a third section adjacent the second section by a second separation, the table top further comprising a second aperture formed within the perimeter of the table across the second separation;

wherein the support structure is attached to the table top to further support the table in:

a second open position, wherein a second tower heater may be placed and accessed within the perimeter of the table without removing any members of the brace; and a second closed position, wherein the second and third sections of the table top abut each other across the second separation and the second tower heater projects through the second aperture.

13. The table of claim 1, wherein:

the table top comprises a frame and a table surface attached to the frame;

each of the plurality of legs is attached to the frame; and the plurality of members of the first brace includes:

two upper horizontal members integral with the frame and abutting each other across the first separation; and two lower horizontal members each attached to at least one of the legs and abutting each other across the first separation.

14. A table having a perimeter around which a plurality of people may sit, the table comprising:

a table top divided into a first section and a second section by a first separation, the table top comprising a first aperture formed within the perimeter of the table across the first separation; and a support structure comprising a plurality of legs and a brace attached to one or more of the legs and comprising a plurality of members, the support structure being attached to the table top to support the table in:

a first open position, wherein a first tower heater may be placed and accessed within the perimeter of the table without removing any members of the brace; and a first closed position, wherein the first and second sections of the table top abut each other across the first separation and the first tower heater projects through the first aperture;

wherein the table top is further divided into a third section adjacent the second section by a second separation, the table top further comprising a second aperture formed within the perimeter of the table across the second separation; and wherein the support structure is attached to the table top to further support the table in:

a second open position, wherein a second tower heater may be placed and accessed within the perimeter of the table without removing any members of the brace; and a second closed position, wherein the second and third sections of the table top abut each other across the second separation and the second tower heater projects through the second aperture.

15. The table of claim 14, wherein the table top is sized to accommodate seating at least six people around the perimeter of the table within either the first tower heater's effective radius or the second tower heater's effective radius.

16. The table of claim 15, wherein the table top has a length and the first tower heater is positioned at ¼ of the length of the table top and the second tower heater is positioned at ¾ of the length of the table top when the table is in the first and second closed positions.

17. A table having a perimeter around which a plurality of people may sit, the table comprising:

a table top divided into a first section and a second section by a first separation, the table top comprising:

a frame and a table surface attached to the frame; and a first aperture formed within the perimeter of the table across the first separation; and a support structure comprising a plurality of legs and a first brace attached to one or more of the legs and comprising:

a plurality of members, including:

two upper horizontal members integral with the frame and abutting each other across the first separation when the table is in the first closed position;

at least two vertical members each attached to one of the upper horizontal members and abutting each other across the first separation when the table is in the first closed position; and two lower horizontal members each attached to at least one of the vertical members and abutting each other across the first separation when the table is in the first closed position;

each of the plurality of legs being attached to the frame and to one of the lower horizontal members;

the support structure being attached to the table top to support the table in:

a first closed position, wherein the first section of the table top abuts the second section of the table top and at least two members of the brace abut each other across the first separation; and a first open position, wherein the first section is opened away from the second section at the first separation; and the support structure being attached to the table top so that the table may be translated between the first closed and first opened positions without removing any members of the brace.

* * * * *